US012668946B2

(12) United States Patent
Arai

(10) Patent No.: US 12,668,946 B2
(45) Date of Patent: Jun. 30, 2026

(54) CONTROL DEVICE, OPERATION DEVICE, CONTROL METHOD, AND WORK VEHICLE

(71) Applicant: Komatsu Ltd., Tokyo (JP)

(72) Inventor: Yuki Arai, Tokyo (JP)

(73) Assignee: KOMATSU LTD., Tokyo (JP)

( * ) Notice: Subject to any disclaimer, the term of this patent is extended or adjusted under 35 U.S.C. 154(b) by 385 days.

(21) Appl. No.: 18/272,626

(22) PCT Filed: Mar. 25, 2022

(86) PCT No.: PCT/JP2022/014222
§ 371 (c)(1),
(2) Date: Jul. 17, 2023

(87) PCT Pub. No.: WO2022/210318
PCT Pub. Date: Oct. 6, 2022

(65) Prior Publication Data

US 2024/0076851 A1 Mar. 7, 2024

(30) Foreign Application Priority Data

Mar. 31, 2021 (JP) ..... 2021-060559

(51) Int. Cl.
*E02F 9/20* (2006.01)
*E02F 3/76* (2006.01)

(52) U.S. Cl.
CPC ..... *E02F 9/2004* (2013.01); *E02F 3/7668* (2013.01); *E02F 3/7672* (2013.01); *E02F 3/7677* (2013.01); *E02F 3/7681* (2013.01)

(58) Field of Classification Search
CPC ..... E02F 9/2004; E02F 3/7668; E02F 3/7672; E02F 3/7677; E02F 3/7681
See application file for complete search history.

(56) References Cited

U.S. PATENT DOCUMENTS

| | | | | | |
|---|---|---|---|---|---|
| H1822 | H * | 12/1999 | Kelley | E02F 9/2004 | 74/471 XY |
| H1831 | H * | 2/2000 | Kelley | E02F 9/2004 | 180/402 |
| 6,152,239 | A * | 11/2000 | Kelley | E02F 9/2025 | 74/523 |
| 8,757,315 | B1 * | 6/2014 | Wuisan | E02F 9/2004 | 180/315 |
| 2002/0166267 | A1 * | 11/2002 | McGugan | E02F 9/2004 | 37/348 |
| 2005/0279561 | A1 * | 12/2005 | Shearer | E02F 9/2004 | 180/333 |
| 2013/0180744 | A1 | 7/2013 | Favreau et al. | | |
| 2013/0306395 | A1 | 11/2013 | Frazier et al. | | |
| 2016/0002885 | A1 * | 1/2016 | Sharma | E02F 9/0841 | 701/41 |

(Continued)

*Primary Examiner* — Joseph M Rocca
*Assistant Examiner* — Julia C Tran
(74) *Attorney, Agent, or Firm* — Troutman Pepper Locke LLP

(57) ABSTRACT

The control device is a control device that controls a drawbar attached to a main frame of a grader, in which a movement of the drawbar is generated by at least three actuators, and the control device controls, based on an output signal from one operation lever having at least three degrees of freedom, the plurality of actuators such that a movement of the one operation lever corresponds to the movement of the drawbar.

5 Claims, 13 Drawing Sheets

(56) References Cited

U.S. PATENT DOCUMENTS

| | | | | |
|---|---|---|---|---|
| 2017/0114523 | A1* | 4/2017 | Horstman | E02F 9/2087 |
| 2017/0145655 | A1* | 5/2017 | Mason | E02F 9/2271 |
| 2020/0173135 | A1 | 6/2020 | Gentle et al. | |
| 2020/0256035 | A1* | 8/2020 | Moloney | G05G 9/047 |

* cited by examiner

CONTROL DEVICE, OPERATION DEVICE, CONTROL METHOD, AND WORK VEHICLE

TECHNICAL FIELD

The present invention relates to a control device, an operation device, a control method, and a work vehicle.

Priority is claimed on Japanese Patent Application No. 2021-060559, filed on Mar. 31, 2021, the content of which is incorporated herein by reference.

BACKGROUND ART

A grader work equipment consists of a blade, a circle, a drawbar, lifters, and the like, and a plurality of actuators are provided for positioning them (for example, Patent Literature 1). For example, there are three actuators that control a movement of the drawbar, the left and right blade lift cylinders and the drawbar shift cylinder, but in order to achieve a desired angle, three axes operations spanning a plurality of operation levers is required, which poses a challenge because the operation is complicated and difficult.

CITATION LIST

Patent Literature

[Patent Literature 1]
United States Patent Application, Publication No. 2020/0173135

SUMMARY OF INVENTION

Technical Problem

The present invention has been made in view of the above circumstances, and an object of the present invention is to provide a control device, an operation device, a control method, and a work vehicle that can be easily operated.

Solution to Problem

In order to solve the above problems, one aspect of the present invention is a control device that controls a drawbar attached to a main frame of a grader, in which a movement of the drawbar is generated by at least three actuators, and the control device controls, based on an output signal from one operation lever having at least three degrees of freedom, the plurality of actuators such that a movement of the one operation lever corresponds to the movement of the drawbar.

In addition, another aspect of the present invention is an operation device including the control device and the operation lever.

In addition, another aspect of the present invention is a control method for controlling a drawbar attached to a main frame of a grader, in which a movement of the drawbar is generated by at least three actuators, the control method including controlling, based on an output signal from one operation lever having at least three degrees of freedom, the plurality of actuators such that a movement of the one operation lever corresponds to the movement of the drawbar.

In addition, still another aspect of the present invention is a work vehicle including a main frame, a drawbar attached to the main frame and restrained to the main frame by a ball shaft, three actuators attached to the main frame to determine a posture of the drawbar, one operation lever operated by an operator, and a control device that controls the actuators based on an output signal from the operation lever, in which the control device controls the actuators such that a movement of the operation lever corresponds to the movement of the drawbar.

Advantageous Effects of Invention

According to each aspect of the present invention, an operation can be simplified.

DESCRIPTION OF EMBODIMENTS

Figure 1:
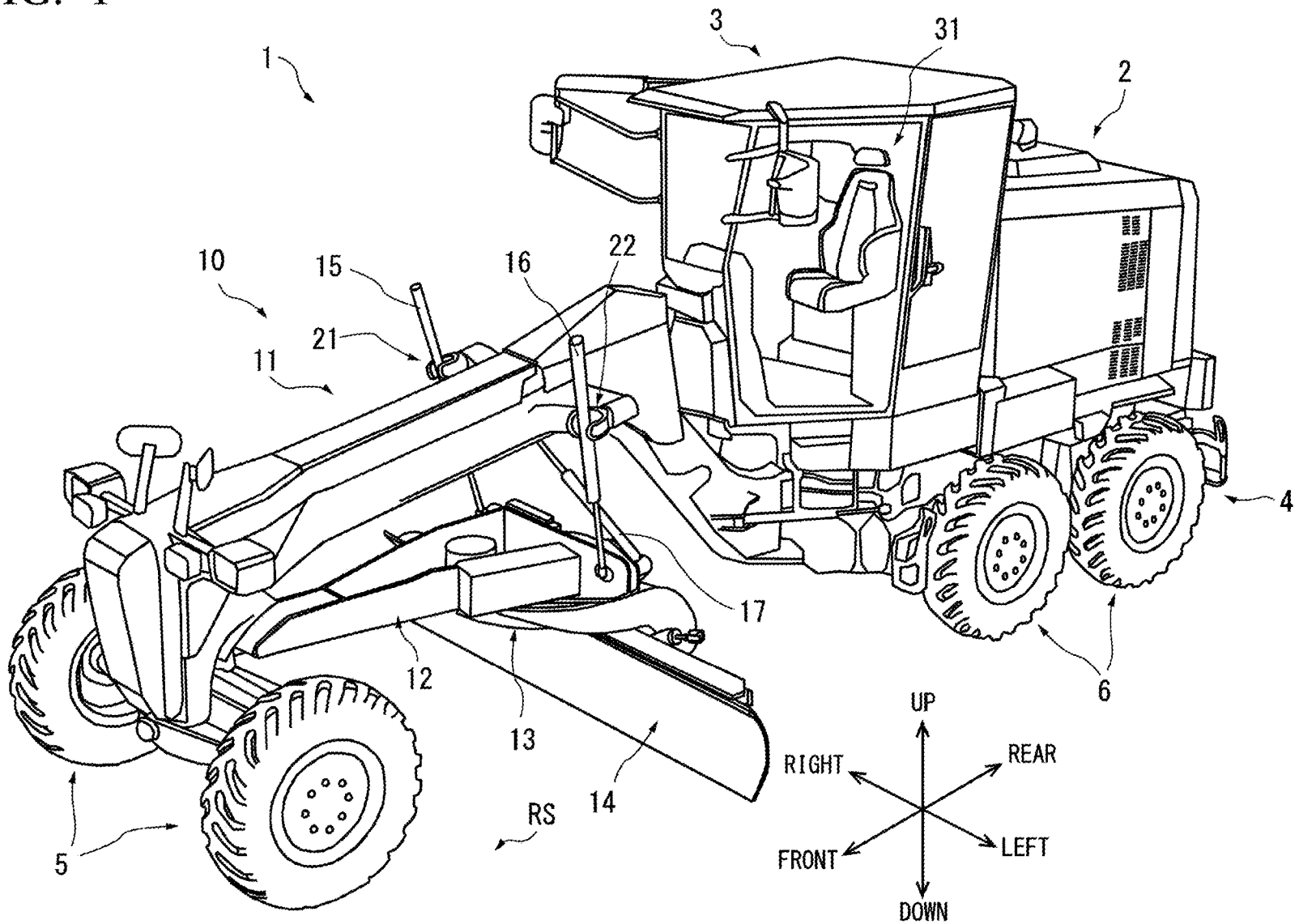
FIG. 1 is a perspective view showing a basic configuration example of a motor grader according to one embodiment of the present invention.

Hereinafter, an embodiment of the present invention will be described with reference to the drawings. In each figure, the same reference numerals are used for the same or corresponding configurations, and the description thereof will be omitted as appropriate.

<Overview of Work Machine>

Figure 2:
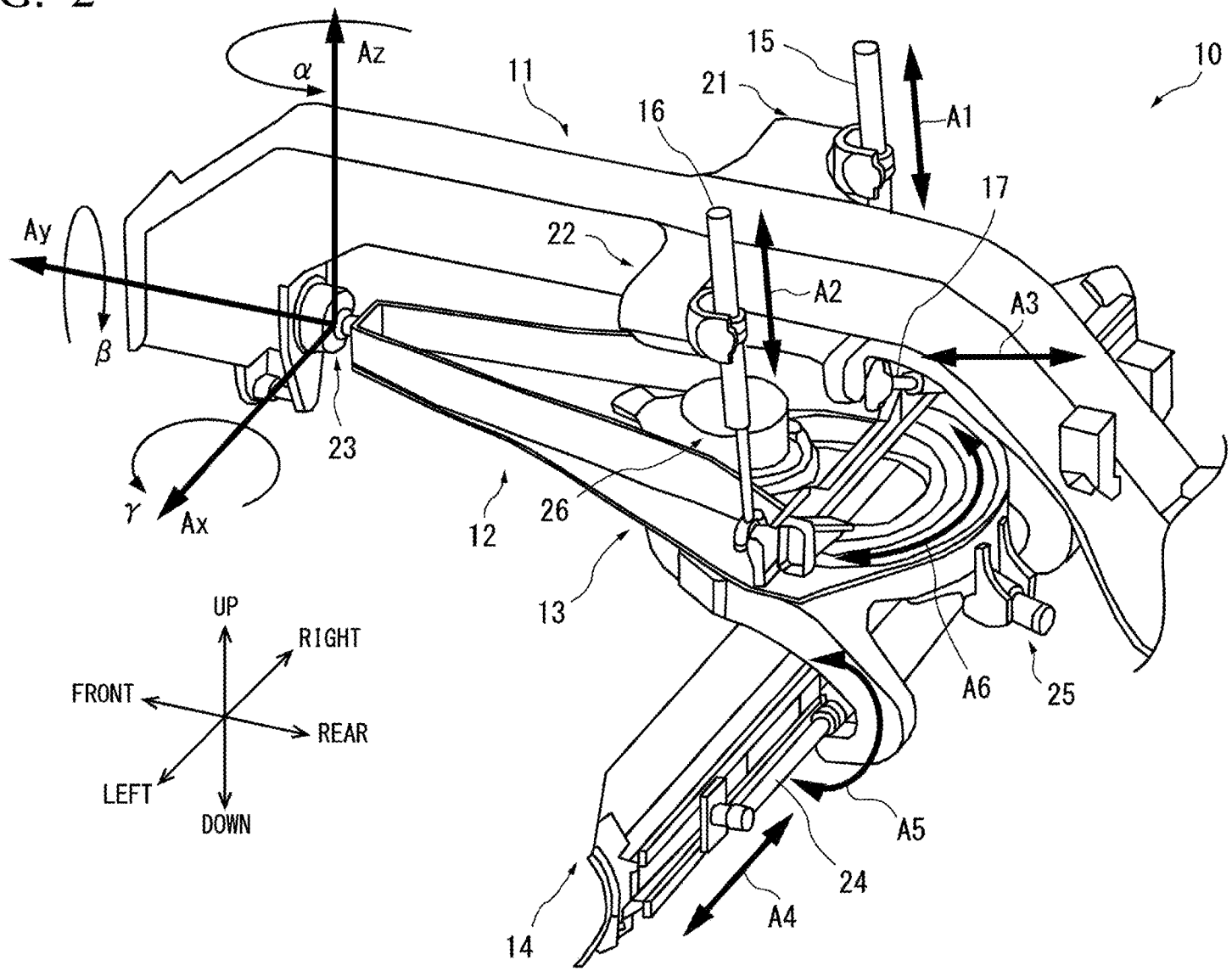
FIG. 2 is a perspective view showing a basic configuration example of a work equipment of a motor grader according to one embodiment of the present invention.

FIG. 1 is a perspective view showing a work machine 1 according to the embodiment. FIG. 2 is a perspective view showing a basic configuration example of a work equipment 10 of the work machine 1 according to the embodiment. The work machine 1 according to the embodiment is, for example, a motor grader (also simply referred to as a grader). In the following description, the work machine 1 will be referred to as a motor grader 1 as appropriate. In addition, the motor grader 1 is an example of a work vehicle. FIG. 1 and FIG. 2 are different models.

In the present embodiment, as shown in FIG. 1, with reference to a vehicle main body 2 of the motor grader 1, a vehicle width direction is defined as a left-right direction, a vertical direction orthogonal to the left-right direction is defined as an up-down direction, and then a vehicle length direction orthogonal to the left-right direction and the up-down direction is defined as a front-rear direction.

As shown in FIG. 1, the motor grader 1 includes a vehicle main body 2, a cab 3, a traveling device 4, and a work equipment 10. The motor grader 1 travels a work site by using the traveling device 4. In the work site, the motor grader 1 performs work by using the work equipment 10. The motor grader 1 can perform work such as road construction (cutting and shaping of roadbed, subgrade, and slope), road maintenance and repair (cutting a gravel road, leveling gravel), snow removal (removal of accumulated and compacted snow), and other work (such as ground leveling of the square, trenching, and weeding) using the work equipment 10. The work machine 1, as long as it includes the work equipment 10 including a drawbar (pulling rod, towing rod) in which a movement is generated by at least three actuators, is not limited to the motor grader 1.

The cab 3 is supported by the vehicle main body 2. The cab 3 is internally provided with a driver's seat 31 on which an operator is seated and an operator operation device (not shown) operated by the operator to operate the motor grader 1.

The traveling device 4 supports the vehicle main body 2. In the present embodiment, the traveling device 4 includes two rotatable front wheels 5 and four rear wheels 6. The motor grader 1 is capable of traveling on a road surface RS by the front wheels 5 and the rear wheels 6 of the traveling device 4. The traveling device of the work machine is not limited to the wheels, and may be a crawler belt or the like.

The work equipment 10 is supported by the vehicle main body 2. As shown in FIGS. 1 and 2, the work equipment 10 includes a main frame 11, a drawbar 12, a circle 13, a blade 14, a right blade lift cylinder 15, a left blade lift cylinder 16, a drawbar shift cylinder 17, a lifter 21, a lifter 22, a ball shaft 23, a blade shift cylinder 24, a power tilt cylinder 25, and a circle rotation motor 26. The right blade lift cylinder 15, the left blade lift cylinder 16, and the drawbar shift cylinder 17 are three actuators that generate a movement of the drawbar 12. The right blade lift cylinder 15, the left blade lift cylinder 16, the drawbar shift cylinder 17, the blade shift cylinder 24, and the power tilt cylinder 25 are hydraulic cylinders. In addition, the circle rotation motor 26 is a hydraulic motor. However, the present invention is not limited to a hydraulic cylinder or a hydraulic motor.

The main frame 11 is a holding unit that supports each unit, is composed of two subframes pin-coupled near the cab 3 and can be refracted (articulated).

The blade 14 is supported to enable shift and tilt with respect to the drawbar 12, and performs excavating, earth-moving, and shaping. The circle 13 is a large gear having teeth on the inner side, which holds the blade 14 and rotates in the direction of arrow A6 by the circle rotation motor 26. In this case, the blade 14 is attached to the drawbar 12.

The drawbar 12 is pivotally and rotatably (hereinafter, referred to as pivotally) restrained to the main frame 11 at an end portion of the drawbar 12 via one ball shaft 23, supporting the circle 13 and receiving a traction force. The ball shaft 23 is also called a ball coupling, a ball joint, or the like, and connects the main frame 11 and the drawbar 12. In this case, the drawbar 12 is attached to the main frame 11 of the motor grader 1. Further, the drawbar 12 is restrained by the main frame 11 and one ball shaft 23.

The right blade lift cylinder 15 is pivotally supported to the main frame 11 via the lifter 21 at its intermediate portion, and pivotally supported to the drawbar 12 at one end portion of the right blade lift cylinder 15, extending and retracting in the direction of arrow A1. The left blade lift cylinder 16 is pivotally supported to the main frame 11 via the lifter 22 at its intermediate portion, and pivotally supported to the drawbar 12 at one end portion of the left blade lift cylinder 16, extending and retracting in the direction of arrow A2. The drawbar shift cylinder 17 is pivotally supported to the main frame 11 at one end portion, and is pivotally supported to the drawbar 12 at the other end portion, extending and retracting in the direction of arrow A3. The right blade lift cylinder 15, the left blade lift cylinder 16, and the drawbar shift cylinder 17 control the position and posture of the drawbar 12.

The blade shift cylinder 24 is connected to the drawbar 12 at one end portion and supported by the blade 14 at the other end portion, extending and retracting in the direction of arrow A4 to laterally shift the blade 14. The power tilt cylinder 25 is connected to the drawbar 12 at one end portion and supported by the blade 14 at the other end portion, changing a cutting angle of the blade 14 in the rotation direction of arrow A5. The cutting angle is the angle formed between the cutting edge of the blade 14 and the road surface RS when the blade 14 is in contact with the road surface (ground) RS.

<Drawbar Control and Input Operation>

In the present embodiment, when controlling the position and posture of the drawbar 12, a rotation direction $\alpha$ is defined with the up-down direction indicated by arrow Az as a rotation axis, a rotation direction $\beta$ with the front-rear direction indicated by arrow Ay as a rotation axis, and a rotation direction $\gamma$ with the left-right direction indicated by arrow Ax as a rotation axis, in which the three directions indicate the directions with respect to the ball shaft 23 which serves as a restraint point of the drawbar 12, taking the pivotal and rotational center of the ball shaft 23 as an origin. The linear movements of the right blade lift cylinder 15, the left blade lift cylinder 16, and the drawbar shift cylinder 17 are controlled by considering them as three axes rotational movements around the ball shaft 23. In addition, an operator's input operation when operating the drawbar 12 is performed using a joy stick 32 (FIG. 3 and FIG. 4), which is an example of one operation lever having at least three degrees of freedom.

Figure 3:
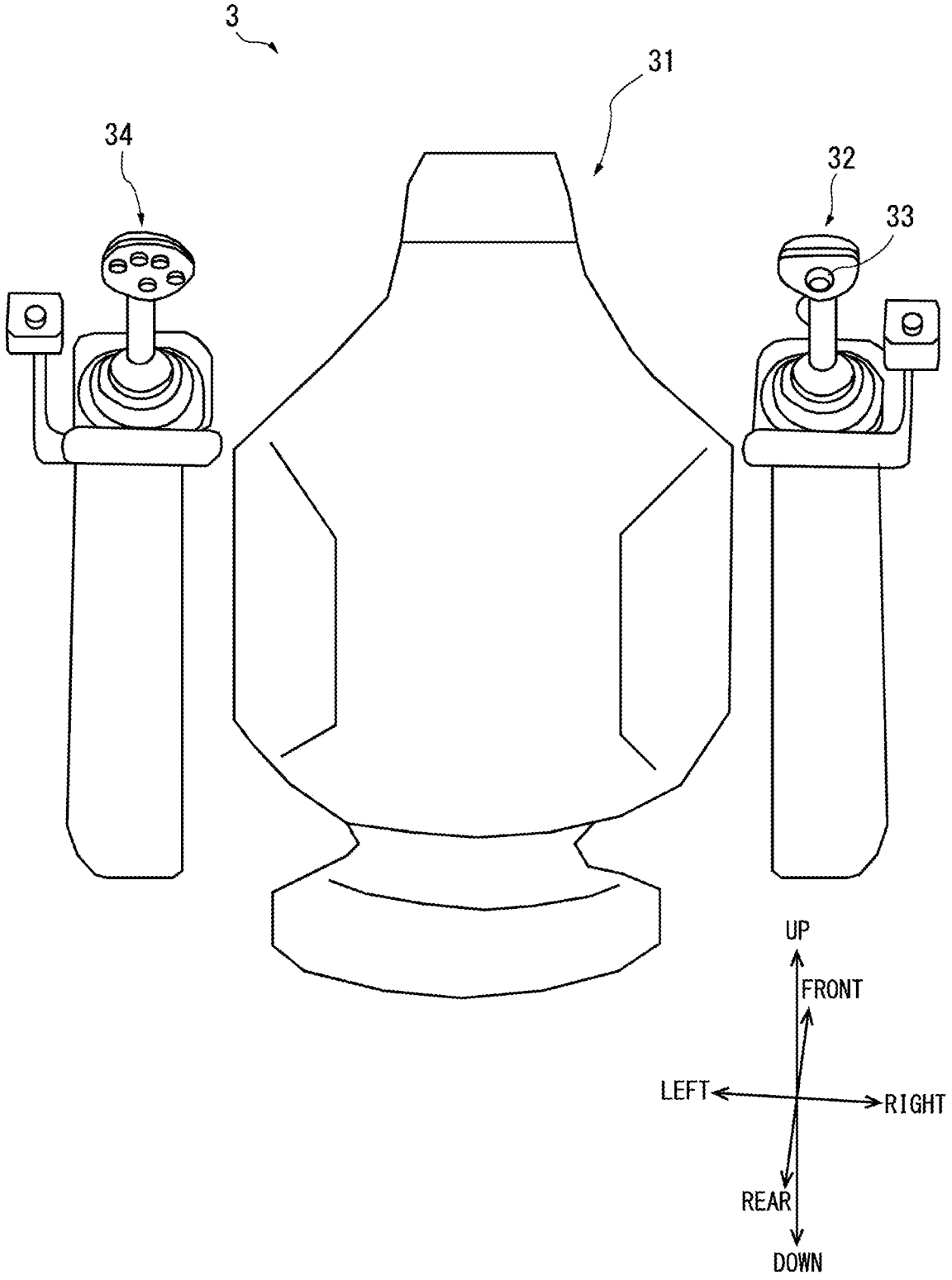
FIG. 3 is a perspective view showing a configuration example of an operator operation device according to one embodiment of the present invention.
Figure 4:
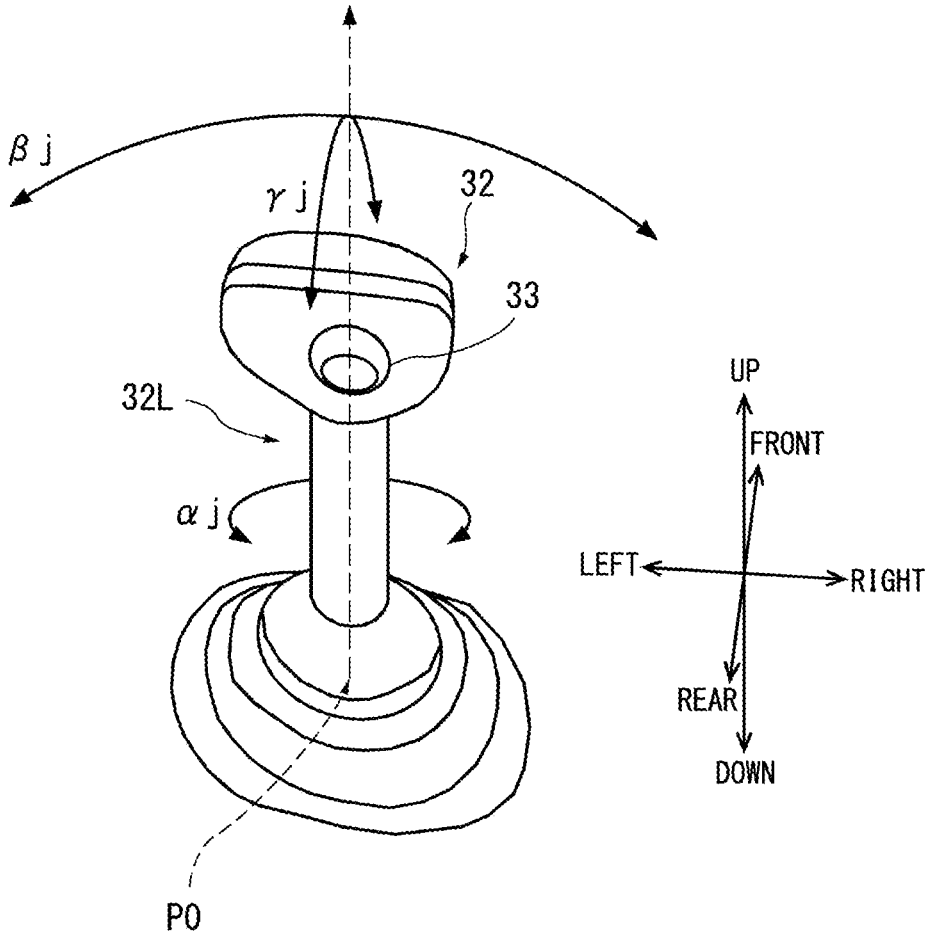
FIG. 4 is a schematic diagram for describing an operation example of a joy stick 32 shown in FIG. 3.

FIG. 3 is a perspective view showing a configuration example of an operator operation device according to one embodiment of the present invention. FIG. 4 is a schematic diagram for describing an operation example of a joy stick 32 shown in FIG. 3. In the example shown in FIG. 3, in the cab 3, a joy stick 32 is provided on the right side of the driver's seat 31 and a joy stick 34 is provided on the left side of the driver's seat 31. In the present embodiment, the joy stick 32 is used as an operation input device when controlling the position and posture of the drawbar 12, and the joy stick 34 is used as, for example, an operation input device when controlling the traveling device 4. As shown in FIG. 4, the joy stick 32 includes a lever 32L, the lever 32L is tiltable at least in the front-rear direction and the left-right direction, and rotatable around the up-down direction as a rotation axis. The tilting direction is not limited to two directions, and for example, may be tiltable in all directions. Further, the lever 32L is held in a neutral state (upright state) when the operator is not operating the joy stick 32, and the joy stick 32 further includes a dead zone region that ignores tilting or rotating within a certain range from the neutral state. In the present embodiment, a rotation direction $\alpha j$ around the axis in the up-down direction of the joy stick 32 is defined as an operation input corresponding to the rotation direction $\alpha$ shown in FIG. 2, and a rotation direction $\beta j$ around the axis in the front-rear direction of the joy stick 32 is defined as an operation input corresponding to the rotation direction 3 shown in FIG. 2, and a rotation direction $\gamma j$ around the axis in the left-right direction of the joy stick 32 is defined as an operation input corresponding to the rotation direction $\gamma$ shown in FIG. 2.

The joy stick 32 further includes a slide switch 33. The slide switch 33 is an example of an operation unit that operates a movement of the blade 14 of the motor grader 1 and the operator can slide the blade 14 left or right by sliding the slide switch 33 left or right.

The joy stick 32 outputs, for example, signals representing rotation angles $\alpha j$, $\beta j$, and $\gamma j$ (or signals representing change amounts $\Delta\alpha j$, $\Delta\beta j$, and $\Delta\gamma j$ of rotation angles $\alpha j$, $\beta j$, and $\gamma j$ per a predetermined time) according to an operation state of the lever 32L. In addition, the joy stick 32 outputs a signal representing the amount of sliding of the slide switch 33.

<Configuration of Control System>

Figure 5:
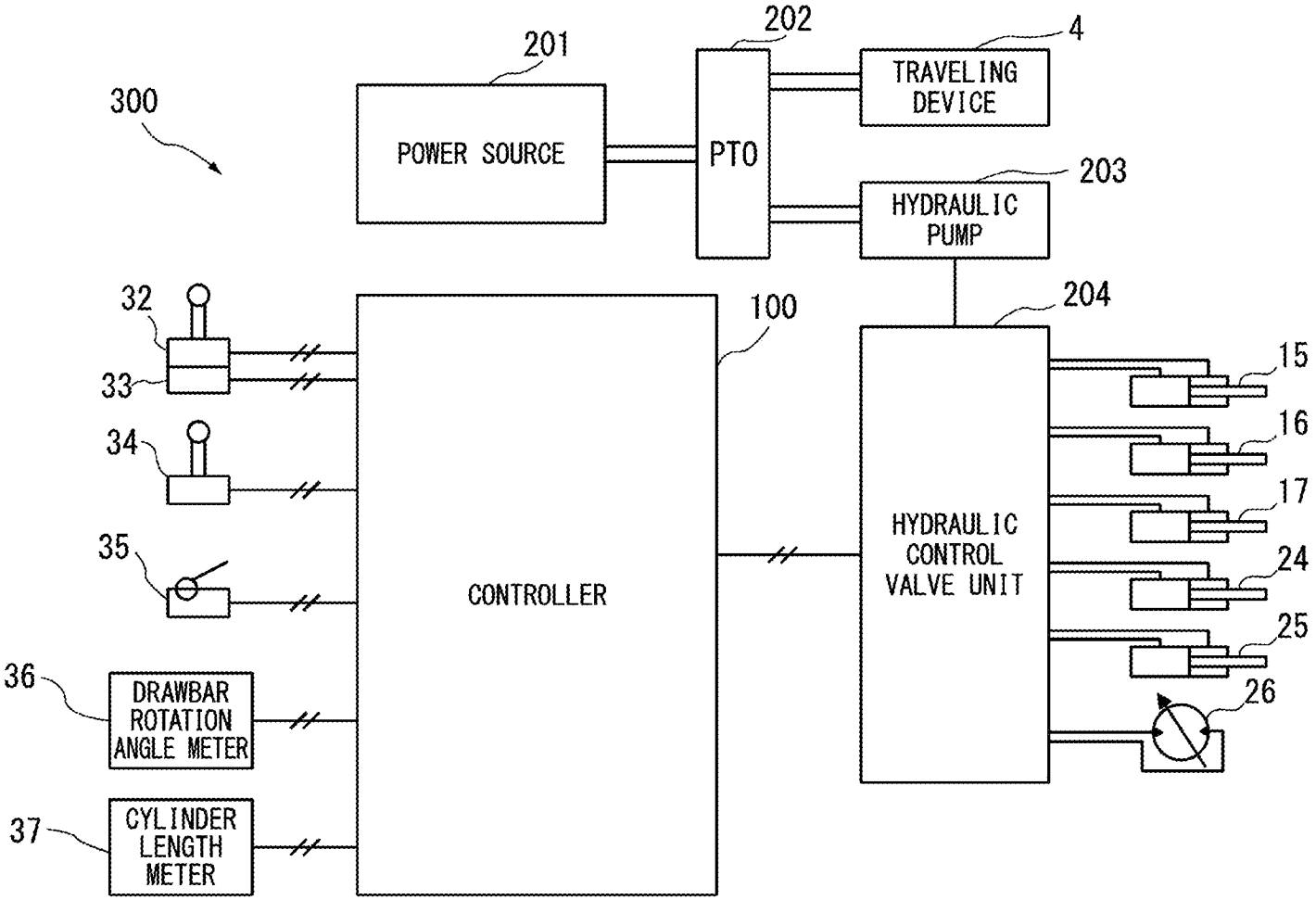
FIG. 5 is a block diagram showing a configuration example of a control system according to one embodiment of the present invention.

FIG. 5 is a block diagram showing a configuration example of a control system 300 of the motor grader 1 according to the embodiment. The control system 300 is an example of an operation device. As shown in FIG. 2, the motor grader 1 includes a power source 201, a Power Take Off (PTO) 202, a traveling device 4, a hydraulic pump 203, a hydraulic control valve unit 204, and a controller 100. The control system 300 may further include the joy stick 32 or the slide switch 33. The controller 100 is an example of a control device, and can be configured using, for example, a computer such as a microcomputer, and its peripheral circuits and peripheral devices, and various functions are implemented by a combination of hardware such as a computer and software such as programs executed by the computer.

The power source 201 generates the power for operating the work machine 1. An internal combustion engine or an electric motor is an example of the power source 201. The power source 201 is not limited to the internal combustion engine or the electric motor. For example, the power source 201 may be a so-called hybrid device in which the internal combustion engine, a generator motor, and a power storage device are combined. In addition, the power source 201 may have a configuration in which the power storage device and the generator motor are combined without having the internal combustion engine.

The PTO 202 transmits at least a portion of the power of the power source 201 to the hydraulic pump 203. The PTO 202 distributes the power of the power source 201 to the traveling device 4 and the hydraulic pump 203.

The traveling device 4 includes, for example, a transmission, a drive shaft, a brake, rear wheels 6, and the like. Front wheels 5 are driven by, for example, a hydraulic motor (not shown).

Under the control of the controller 100, the hydraulic control valve unit 204 controls the flow rate and direction of hydraulic fluid supplied to each of the right blade lift cylinder 15, the left blade lift cylinder 16, the drawbar shift cylinder 17, the blade shift cylinder 24, the power tilt cylinder 25, and the circle rotation motor 26.

In addition, the output signal of the joy stick 32, the amount of sliding of the slide switch 33, the output signal of the joy stick 34, the amount of operation of an accelerator pedal 35 provided in the cab 3, the output signal of a drawbar rotation angle meter 36, a cylinder length meter 37, and the like are input to the controller 100. The accelerator pedal 35 is an input operation device of the operator and indicates output of the power source 201. In addition, the drawbar rotation angle meter 36 measures (calculates) a drawbar rotation angle ($\alpha$, $\beta$, $\gamma$) shown in FIG. 2, and outputs the measured (calculated) result. The drawbar rotation angle meter 36 can consist of one or more sensors that measure the axis rotation angle (pivot angle) of the ball shaft 23 or the rotation angles at a plurality of locations of the drawbar 12 with respect to the main frame 11, and a control unit that converts the measured value of the sensor into the drawbar rotation angle ($\alpha$, $\beta$, $\gamma$), and the like. The cylinder length meter 37 measures (calculates) a cylinder length L1 of the right blade lift cylinder 15, a cylinder length L2 of the left blade lift cylinder 16, and a cylinder length L3 of the drawbar shift cylinder 17, and outputs the measured (calculated) results. The cylinder length meter 37 can consist of sensors that measure cylinder lengths L1, L2 and L3, a control unit that converts the measured values of the plurality of sensors that detect the rotation angle of each cylinder into the cylinder length (L1, L2, L3), and the like.

<Operation Example of Control System>

Figure 6:
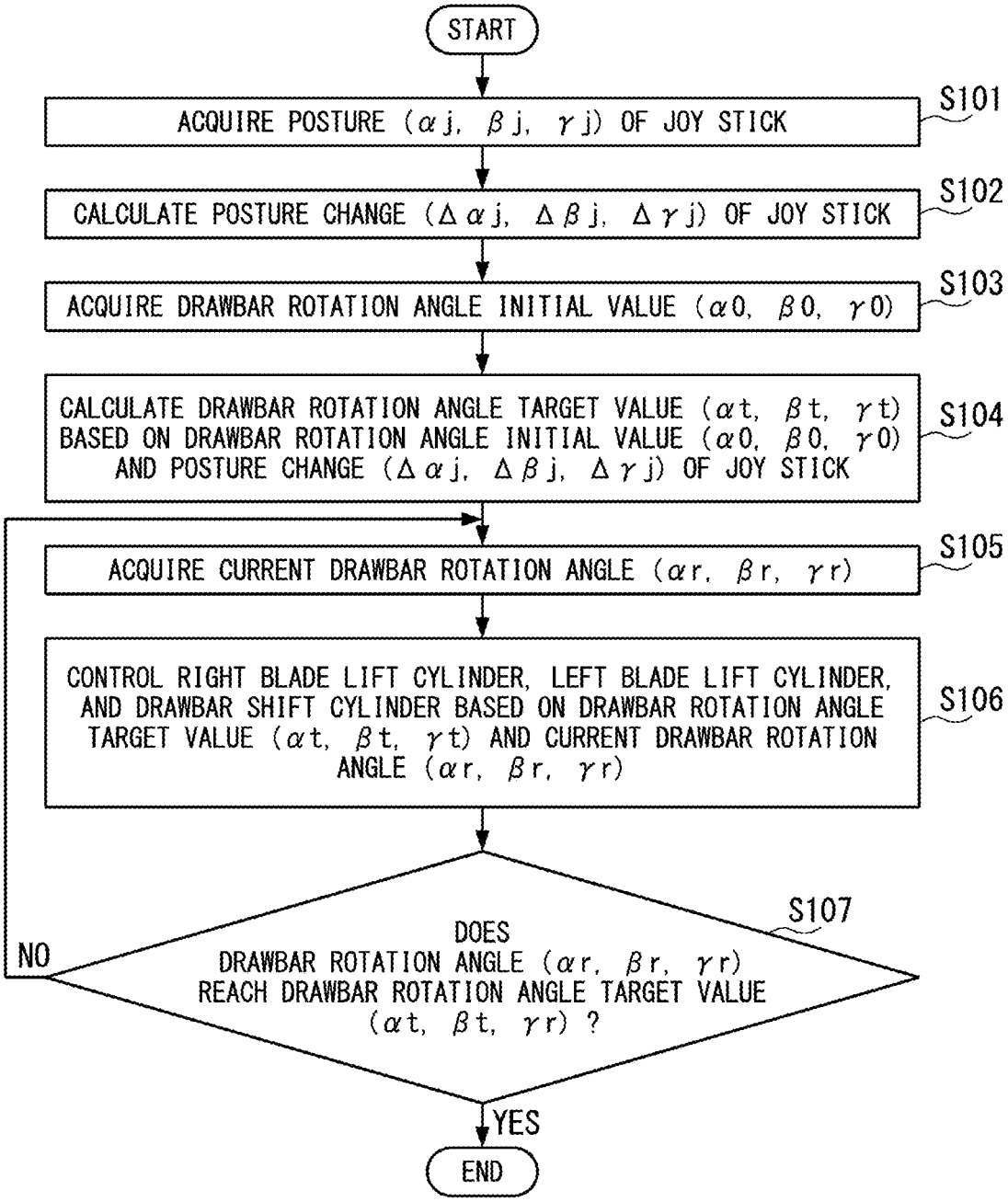
FIG. 6 is a flowchart showing an operation example of a controller 100 shown in FIG. 5.

FIG. 6 is a flowchart showing an operation example of the controller 100 shown in FIG. 5. The processing shown in FIG. 6 is repeatedly executed in a predetermined cycle, for example, in a case where an input operation beyond the dead zone region is performed by the joy stick 32.

When the processing shown in FIG. 6 is started, the controller 100 first acquires the posture ($\alpha j$, $\beta j$, $\gamma j$) of the joy stick 32 (step S101). Next, the controller 100 calculates the posture change ($\Delta\alpha j$, $\Delta\beta j$, $\Delta\gamma j$) of the joy stick 32 based on the posture ($\alpha j$, $\beta j$, $\gamma j$) one processing before (one cycle before) and the present posture ($\alpha j$, $\beta j$, $\gamma j$) (step S102). Next, the controller 100 acquires the drawbar rotation angle ($\alpha$, $\beta$, $\gamma$) output by the drawbar rotation angle meter 36 and sets the drawbar rotation angle ($\alpha$, $\beta$, $\gamma$) as the drawbar rotation angle initial value ($\alpha 0$, $\beta 0$, $\gamma 0$) (step S103).

Next, the controller 100 calculates a drawbar rotation angle target value ($\alpha t$, $\beta t$, $\gamma t$) based on the drawbar rotation angle initial value ($\alpha 0$, $\beta 0$, $\gamma 0$) and the posture change ($\Delta\alpha j$, $\Delta\beta j$, $\Delta\gamma j$) of the joy stick (step S104). The drawbar rotation angle target value ($\alpha t$, $\beta t$, $\gamma t$) is, for example, a value obtained by adding a value obtained by multiplying the posture change ($\Delta\alpha j$, $\Delta\beta j$, $\Delta\gamma j$) of the joy stick by a predetermined coefficient to the drawbar rotation angle initial value ($\alpha 0$, $\beta 0$, $\gamma 0$) for each component. The predetermined coefficient can be, for example, a value that can be adjusted by the operator within a certain range.

Next, the controller 100 acquires the drawbar rotation angle ($\alpha$, $\beta$, $\gamma$) output by the drawbar rotation angle meter 36 and sets the drawbar rotation angle ($\alpha$, $\beta$, $\gamma$) as the current drawbar rotation angle ($\alpha r$, $\beta r$, $\gamma r$) (step S105). Next, the controller 100 controls the right blade lift cylinder 15, the left blade lift cylinder 16, and the drawbar shift cylinder 17 based on the drawbar rotation angle target value ($\alpha t$, $\beta t$, $\gamma$) and the current drawbar rotation angle ($\alpha r$, $\beta r$, $\gamma r$) (step S106). Next, the controller 100 determines whether the current drawbar rotation angle ($\alpha r$, $\beta r$, $\gamma r$) reaches the drawbar rotation angle target value ($\alpha t$, $\beta t$, $\gamma t$) (whether the current drawbar rotation angle ($\alpha r$, $\beta r$, $\gamma r$) is within the drawbar rotation angle target value ($\alpha t$, $\beta t$, $\gamma t$)) (step S107).

In a case where the current drawbar rotation angle ($\alpha r$, $\beta r$, $\beta r$, $\gamma r$) reaches the drawbar rotation angle target value ($\alpha t$, $\beta t$, $\gamma t$) (in case of "YES" in step S107), the controller 100 ends the processing shown in FIG. 6. On the other hand, in a case where the current drawbar rotation angle ($\alpha r$, $\beta r$, $\gamma r$) does not reach the drawbar rotation angle target value ($\alpha t$, $\beta t$, $\gamma t$) (in case of "NO" in step S107), the controller 100 re-executes the processing from step S105 onwards.

By the above processing, the controller 100 can change the rotation angle ($\alpha$, $\beta$, $\gamma$) of the drawbar 12 to correspond to the operation input (change ($\Delta\alpha j$, $\Delta\beta j$, $\Delta\gamma j$) of the rotation angle ($\alpha j$, $\beta j$, $\gamma j$)) to the lever 32L of the joy stick 32. In this case, the drawbar 12 moves in the same direction as the lever rotation operation by the operator.

Figure 7:
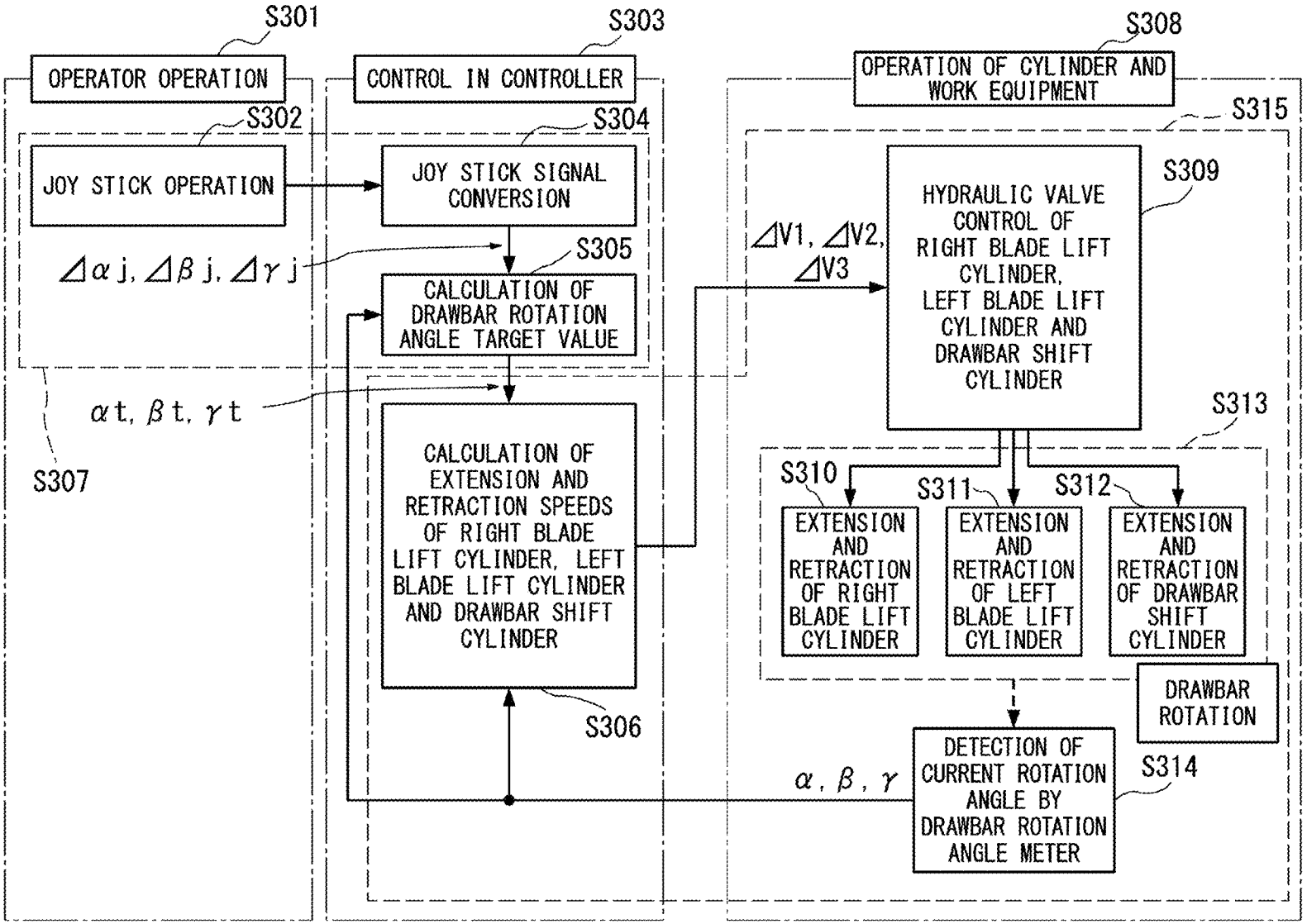
FIG. 7 is a system diagram showing an operation example of a control system 300 shown in FIG. 5.

FIG. 7 is a system diagram showing an operation example of the control system 300 corresponding to the operation example shown in FIG. 6. In the operation example shown in FIG. 7, when the operation of the joy stick 32 is performed (S302) as the operator operation (S301), the joy stick signal conversion (S304) is performed in the controller 100, and the posture change ($\Delta\alpha j$, $\Delta\beta j$, $\Delta\beta$) of the joy stick is calculated. In the controller 100, the drawbar rotation angle target value ($\alpha t$, $\beta t$, $\gamma t$) is further calculated based on the posture change ($\Delta\alpha j$, $\Delta\beta j$, $\Delta\gamma j$) of the joy stick and the current drawbar rotation angle ($\alpha$, $\beta$, $\gamma$) (S305).

In the controller 100 (S303), extension and retraction speeds $\Delta V1$, $\Delta V2$, and $\Delta V3$ of the right blade lift cylinder 15, the left blade lift cylinder 16, and the drawbar shift cylinder 17 are further calculated based on (a deviation of) the current drawbar rotation angle ($\alpha$, $\beta$, $\gamma$) and the drawbar rotation angle target value ($\alpha t$, $\beta t$, $\gamma t$) (S306).

Next, as the operation of the cylinder and work equipment (S308), the hydraulic valve control of the right blade lift cylinder 15, the left blade lift cylinder 16, and the drawbar shift cylinder 17 is performed based on the extension and retraction speeds $\Delta V1$, $\Delta V2$, and $\Delta V3$ (S309). Here, the extension and retraction of the right blade lift cylinder (S310), the extension and retraction of the left blade lift cylinder (S311), and the extension and retraction of the drawbar shift cylinder (S312) are performed to rotate the drawbar 12 (S313). In addition, the current rotation angle is newly detected by the drawbar rotation angle meter 36 (S314).

The processing in the block S315 is executed in a shorter cycle than the processing in the block S307.

By the above processing, the control system 300 can change the rotation angle ($\alpha$, $\beta$, $\gamma$) of the drawbar 12 to correspond to the operation input (change ($\Delta\alpha j$, $\Delta\beta j$, $\Delta\gamma j$) of the rotation angle ($\alpha j$, $\beta j$, $\gamma j$)) to the lever 32L of the joy stick 32. In this case, the drawbar 12 moves in the same direction as the lever rotation operation by the operator.

Figure 8:
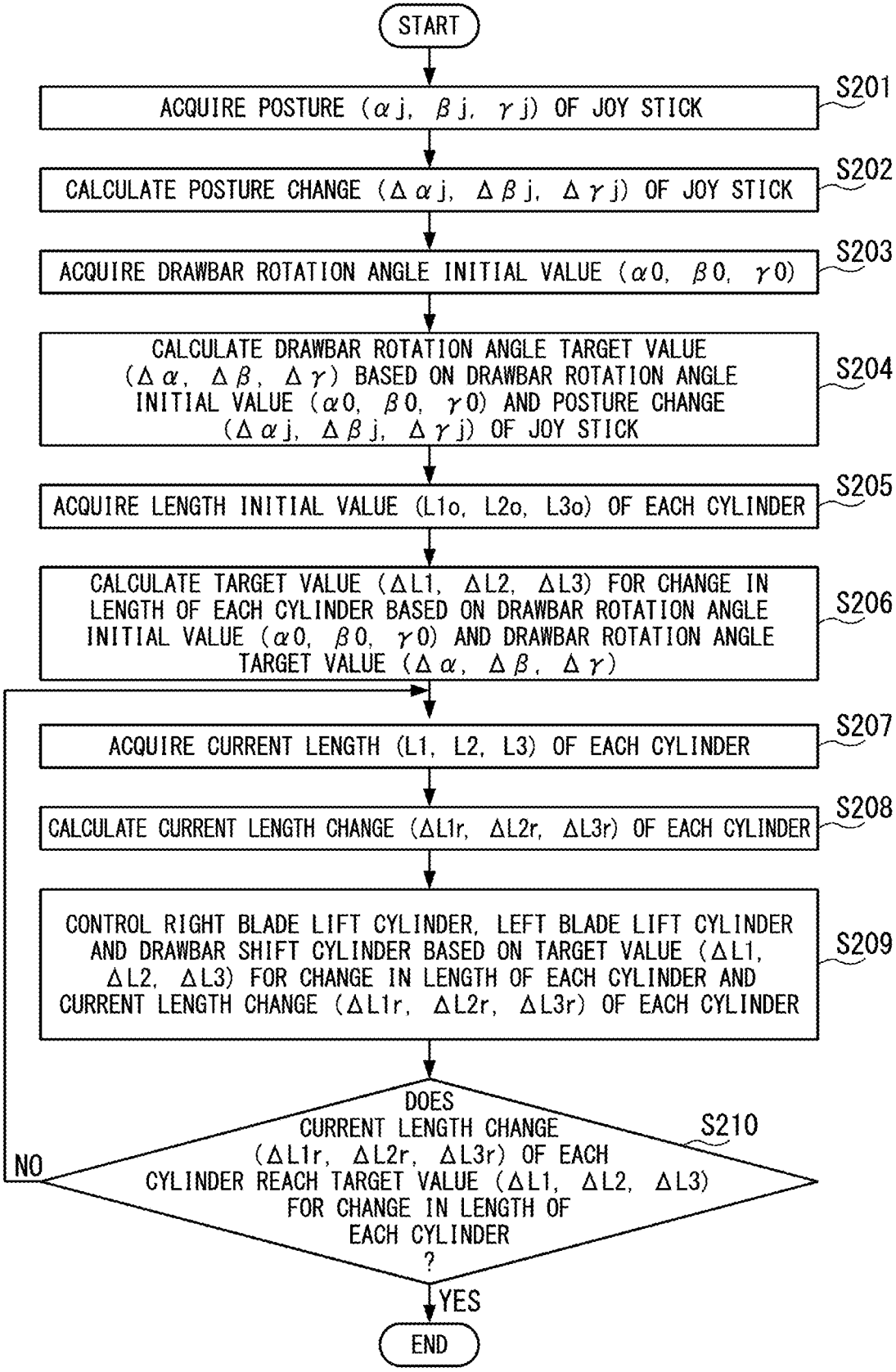
FIG. 8 is a flowchart showing another operation example of the controller 100 shown in FIG. 5.

Next, another operation example will be described with reference to FIG. 8. FIG. 8 is a flowchart showing another operation example of the controller 100 shown in FIG. 5. The processing shown in FIG. 8 is repeatedly executed in a predetermined cycle, for example, in a case where an input operation beyond the dead zone region is performed by the joy stick 32.

When the processing shown in FIG. 8 is started, the controller 100 first acquires the posture ($\alpha j$, $\beta j$, $\gamma j$) of the joy stick 32 (step S201). Next, the controller 100 calculates the posture change ($\Delta\alpha j$, $\Delta\beta j$, $\Delta\gamma j$) of the joy stick 32 based on the posture one processing before ($\alpha j$, $\beta j$, $\gamma j$) and the current posture ($\alpha j$, $\beta j$, $\gamma j$) (step S202). Next, the controller 100 acquires the drawbar rotation angle ($\alpha$, $\beta$, $\gamma$) output by the drawbar rotation angle meter 36 and sets the drawbar rotation angle ($\alpha$, $\beta$, $\gamma$) as the drawbar rotation angle initial value ($\alpha 0$, $\beta 0$, $\gamma 0$) (step S203). The drawbar rotation angle initial value ($\alpha 0$, $\beta 0$, $\gamma 0$) may be calculated using the drawbar rotation angle ($\alpha$, $\beta$, $\gamma$) calculated from the current length (L1, L2, L3) of each cylinder without using the drawbar rotation angle meter 36. In this case, the calibration of the drawbar angle and the cylinder length is performed in advance.

Next, the controller 100 calculates the drawbar rotation angle target value ($\Delta\alpha$, $\Delta\beta$, $\Delta\gamma$) based on the drawbar rotation angle initial value ($\alpha 0$, $\beta 0$, $\gamma 0$) and the posture change ($\Delta\alpha j$, $\Delta\beta j$, $\Delta\gamma j$) of the joy stick (step S204). The drawbar rotation angle target value ($\alpha t$, $\beta t$, $\gamma t$) is, for example, a value based on the drawbar rotation angle initial value ($\alpha 0$, $\beta 0$, $\gamma 0$) and a value obtained by multiplying the posture change ($\Delta\alpha j$, $\Delta\beta j$, $\Delta\gamma j$) of the joy stick by a predetermined coefficient for each component. The predetermined coefficient can be, for example, a value that can be adjusted by the operator within a certain range.

Next, the controller 100 acquires the current length (L1, L2, L3) of each cylinder and sets the current length (L1, L2, L3) as the length initial value (L1o, L2o, L3o) of each cylinder (step S205). Next, the controller 100 calculates the target value ($\Delta L1$, $\Delta L2$, $\Delta L3$) for the change in length of each cylinder based on the drawbar rotation angle initial value ($\alpha 0$, $\beta 0$, $\gamma 0$) and the drawbar rotation angle target value ($\Delta\alpha$, $\Delta\beta$, $\Delta\gamma$) (step S206).

In step S206, the controller 100 uses a rotation matrix and a coordinate transformation matrix to calculate the target value ($\Delta L1$, $\Delta L2$, $\Delta L3$) for the change in length of each cylinder to correspond to the drawbar rotation angle target value ($\Delta\alpha$, $\Delta\beta$, $\Delta\gamma$). In the present embodiment, the mechanism of the drawbar 12 is classified into a model of a rotational three degrees of freedom parallel mechanism, in terms of machine kinematics. In the rotational three degrees of freedom parallel mechanism, there is one cylinder length (L1, L2, L3) for each of the right blade lift cylinder 15, the left blade lift cylinder 16, and the drawbar shift cylinder 17, which achieves the desired posture ($\alpha$, $\beta$, $\gamma$) of the drawbar 12. Therefore, when each cylinder length is adjusted at the same time, it is possible to control the posture ($\alpha$, $\beta$, $\gamma$) of the drawbar 12. That is, it is possible to calculate the amount of extension and retraction of the cylinder required for angular rotation from the three axes angles, which are lever input angle signals of the joy stick 32. By using the rotation matrix, it is possible to calculate a change in the coordinates of a restraint point of each cylinder on the drawbar 12. In addition, since the coordinates of the restraint point on the vehicle main body 2 side do not change, the length of each cylinder after the rotation of the drawbar 12 can be calculated.

Next, the controller 100 acquires the current length (L1, L2, L3) of each cylinder (step S207) and calculates the current length change ($\Delta L1r$, $\Delta L2r$, $\Delta L3r$) of each cylinder (step S208). Next, the controller 100 controls the right blade lift cylinder 15, the left blade lift cylinder 16, and the drawbar shift cylinder 17 based on the target value ($\Delta L1$, $\Delta L2$, $\Delta L3$) for the change in length of each cylinder and the current length change ($\Delta L1r$, $\Delta L2r$, $\Delta L3r$) of each cylinder (step S209). Next, the controller 100 determines whether the current length change (ΔL1r, ΔL2r, ΔL3r) of each cylinder reaches the target value (ΔL1, ΔL2, ΔL3) for the change in the length of each cylinder (step S210).

In a case where the current length change (ΔL1r, ΔL2r, ΔL3r) of each cylinder reaches the target value (ΔL1, ΔL2, ΔL3) for the change in the length of each cylinder (in case of "YES" in step S210), the controller 100 ends the processing shown in FIG. 8. On the other hand, in a case where the current length change (ΔL1r, ΔL2r, ΔL3r) of each cylinder does not reach the target value (ΔL1, ΔL2, ΔL3) for the change in the length of each cylinder (in case of "NO" in step S210), the controller 100 re-executes the processing from step S207 onwards.

By the above processing, the controller 100 can change the rotation angle (α, β, γ) of the drawbar 12 to correspond to the operation input (change (Δαj, Δβj, Δγj) of the rotation angle (αj, βj, γj)) to the lever 32L of the joy stick 32. In this case, the drawbar 12 moves in the same direction as the lever rotation operation by the operator.

Figure 9:
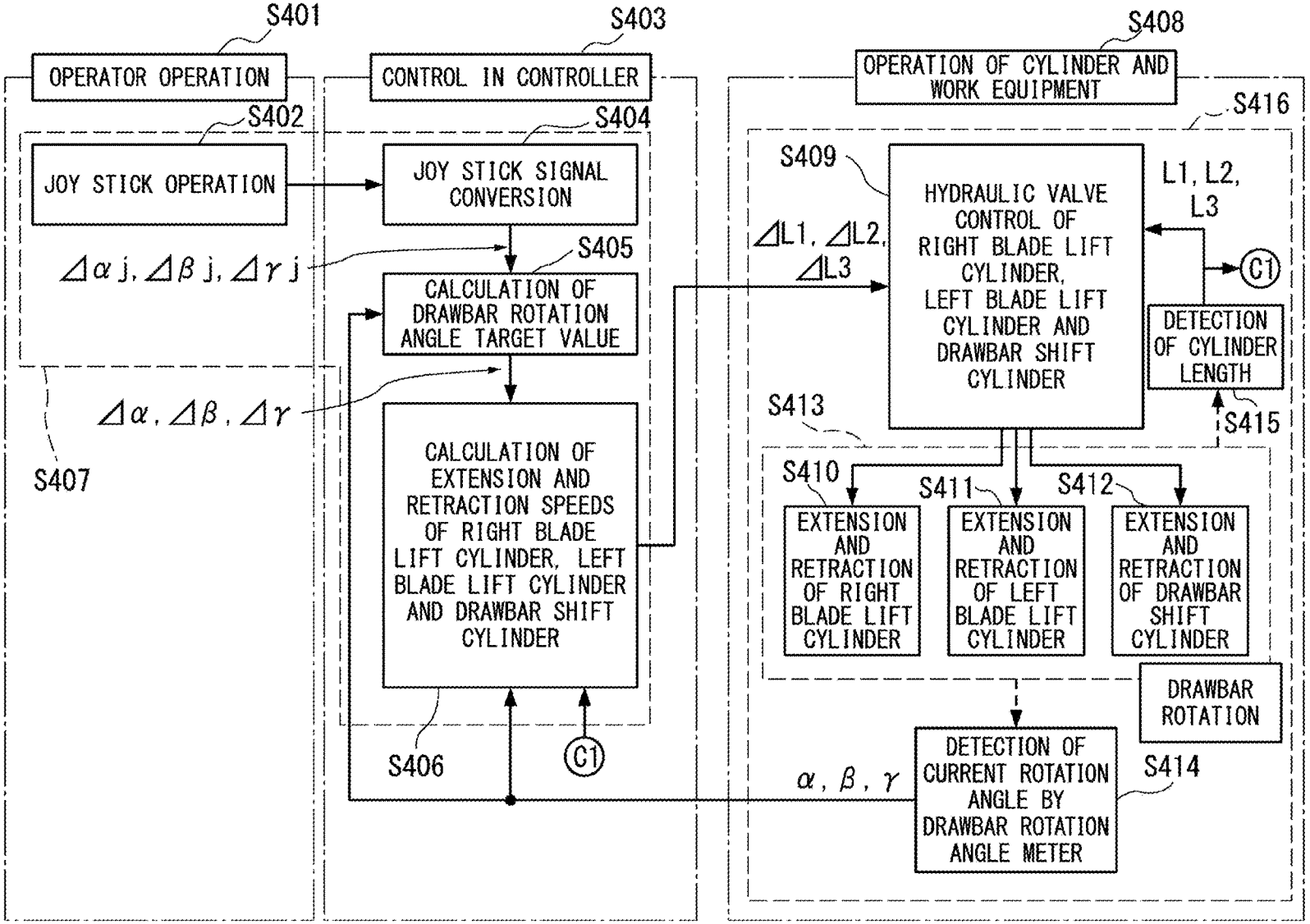
FIG. 9 is a system diagram showing another operation example of the control system 300 shown in FIG. 5.

FIG. 9 is a system diagram showing an operation example of the control system 300 corresponding to the operation example shown in FIG. 8. In the operation example shown in FIG. 9, when the operation of the joy stick 32 is performed (8402) as the operator operation (S401), the joy stick signal conversion (S404) is performed in the controller 100, and the posture change (Δαj, Δβj, Δγj) of the joy stick is calculated. In the controller 100, the drawbar rotation angle target value (Δα, Δβ, Δγ) is further calculated based on the posture change (Δβj, Δβj, Δγj) of the joy stick and the current drawbar rotation angle (α, β, γ) (S405).

In the controller 100 (S403), the amounts of the extension and retraction ΔL1, ΔL2, and ΔL3 of the right blade lift cylinder 15, the left blade lift cylinder 16, and the drawbar shift cylinder 17 are further calculated based on the current drawbar rotation angle (α, β, γ), the drawbar rotation angle target value (Δα, Δβ, Δγ), and the cylinder length (L1, L2, L3) (406).

Next, as the operation of the cylinder and work equipment (8408), the hydraulic valve control of the right blade lift cylinder 15, the left blade lift cylinder 16, and the drawbar shift cylinder 17 is performed based on the amounts of the extension and retraction ΔL1, ΔL2, and ΔL3 (S409). Here, the extension and retraction of the right blade lift cylinder (8410), the extension and retraction of the left blade lift cylinder (8411), and the extension and retraction of the drawbar shift cylinder (8412) are performed to rotate the drawbar 12 (S413). In addition, the current rotation angle is newly detected by the drawbar rotation angle meter 36 (S414). In addition, the current cylinder length (L1, L2, L3) is newly detected by the cylinder length meter 37 (S415).

The processing in the block S416 is executed in a shorter cycle than the processing in the block 8407.

By the above processing, the control system 300 can change the rotation angle (α, β, γ) of the drawbar 12 to correspond to the operation input (change (Δαj, Δβj, Δγj) of the rotation angle (αj, βj, γj)) to the lever 32L of the joy stick 32. In this case, the drawbar 12 moves in the same direction as the lever rotation operation by the operator.

<Operation Example of Motor Grader>

Next, an operation example of the motor grader 1 will be described with reference to FIGS. 10 to 17. FIGS. 10 to 17 are plan views and side views for describing an operation example of the motor grader according to one embodiment of the present invention.

Figure 10:
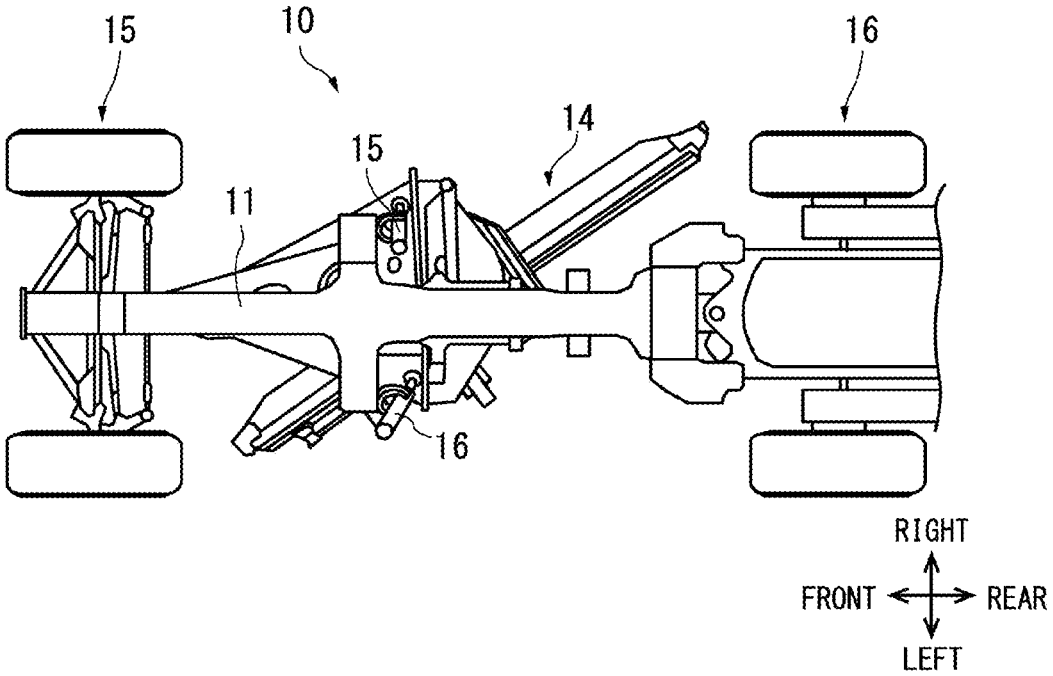
FIG. 10 is a plan view for describing an operation example of a motor grader according to one embodiment of the present invention.
Figure 11:
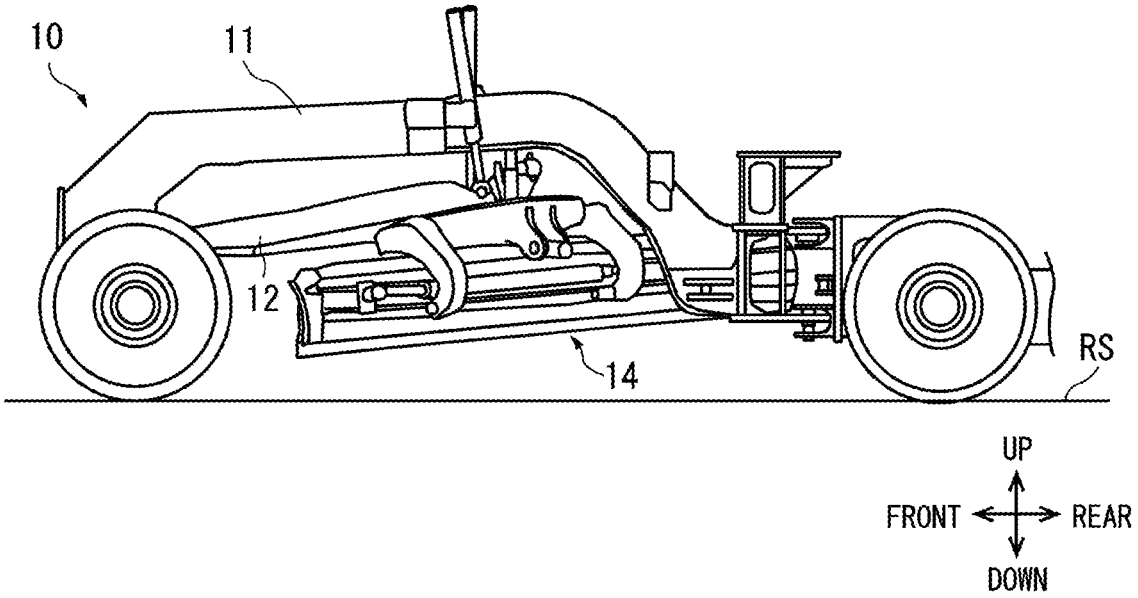
FIG. 11 is a side view for describing an operation example of a motor grader according to one embodiment of the present invention.

FIG. 10 is a plan view showing the motor grader 1 in a traveling posture. FIG. 11 is a side view showing the motor grader 1 in a traveling posture. In a case of transitioning to the traveling posture, it is necessary to move the blade 14 upward. In this case, the operator performs a rotation operation around the axis in the left-right direction (rotation operation in a γj direction) with respect to the joy stick 32 shown in FIG. 4, so that it is possible to lift the drawbar 12 without tilting the drawbar 12 around the front-rear axis (P direction in FIG. 2). Therefore, the operation is easy to operate.

In a case where the traveling posture is set using the three operation levers that operate the cylinder lengths of the right blade lift cylinder 15, the left blade lift cylinder 16, and the drawbar shift cylinder 17, operations, which adjust a tilt by the drawbar shift cylinder 17 since the drawbar 12 tilts when the drawbar 12 is slightly lifted by the right blade lift cylinder 15 and the left blade lift cylinder 16, and adjust a tilt by the drawbar shift cylinder 17 since the drawbar 12 tilts when the drawbar 12 is slightly lifted by the right blade lift cylinder 15 and the left blade lift cylinder 16, need to be repeated multiple times.

Figure 12:
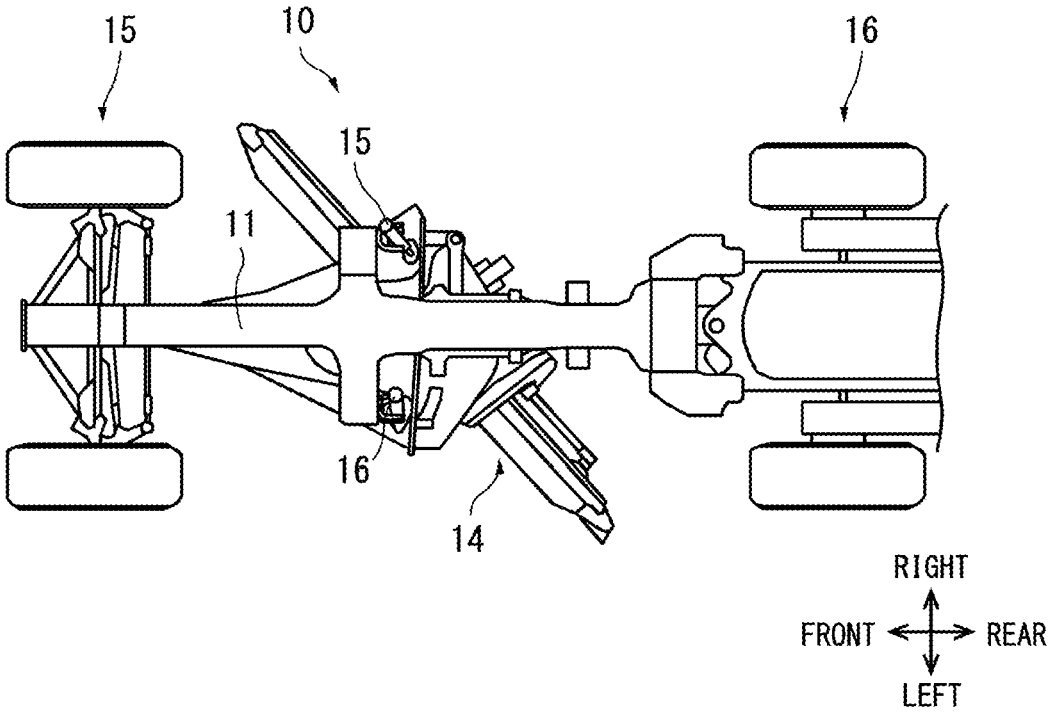
FIG. 12 is a plan view for describing an operation example of a motor grader according to one embodiment of the present invention.
Figure 13:
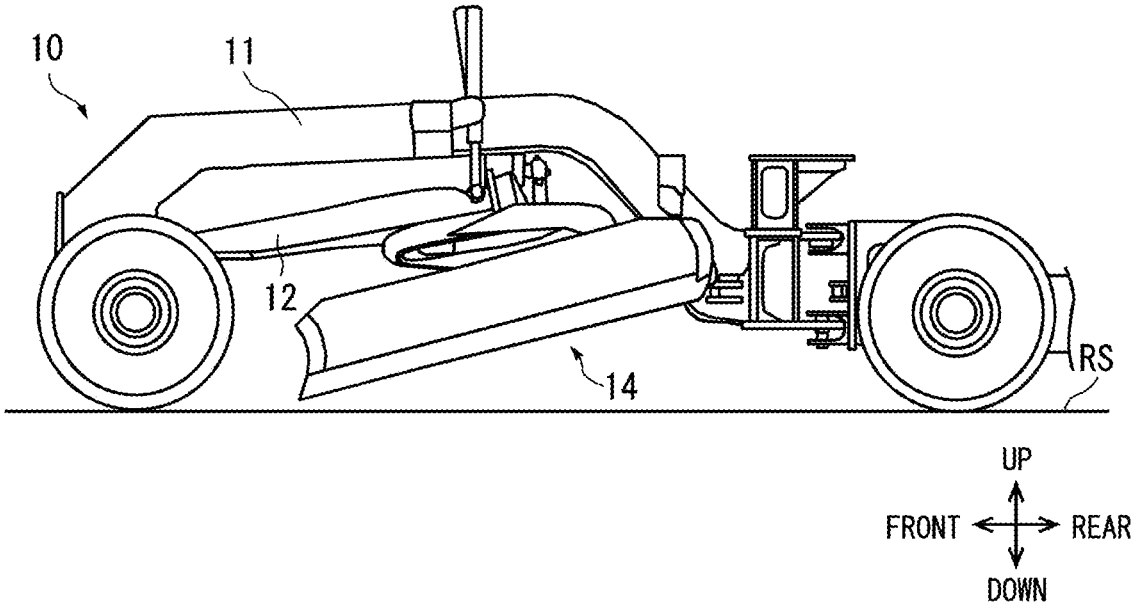
FIG. 13 is a side view for describing an operation example of a motor grader according to one embodiment of the present invention.

FIG. 12 is a plan view showing the motor grader 1 in a trenching posture. FIG. 13 is a side view showing the motor grader 1 in a trenching posture. In a case of transitioning to the trenching posture, it is necessary to lower the right side of the drawbar 12 after moving the blade 14 upward. In this case, the operator first performs a rotation operation around the axis in the left-right direction (rotation operation in a γj direction) with respect to the joy stick 32 shown in FIG. 4, so that it is possible to lift the drawbar 12 without tilting the drawbar 12 around the front-rear axis (β direction in FIG. 2). Next, the operator performs a rotation operation (rotation operation in a βj direction) around the axis in the front-rear direction with respect to the joy stick 32 shown in FIG. 4, so that it is possible to lower the right side of the drawbar 12. In this case as well, the drawbar 12 can be lifted without tilting the drawbar 12 around the front-rear axis (β direction in FIG. 2) during the rotation operation in the γj direction, so that the operation is easy to operate.

In a case where the trenching posture is set using the three operation levers that operate the cylinder lengths of the right blade lift cylinder 15, the left blade lift cylinder 16, and the drawbar shift cylinder 17, when lifting the drawbar 12, operations, which adjust a tilt by the drawbar shift cylinder 17 since the drawbar 12 tilts when the drawbar 12 is slightly lifted by the right blade lift cylinder 15 and the left blade lift cylinder 16, and adjust a tilt by the drawbar shift cylinder 17 since the drawbar 12 tilts when the drawbar 12 is slightly lifted by the right blade lift cylinder 15 and the left blade lift cylinder 16, need to be repeated multiple times.

Figure 14:
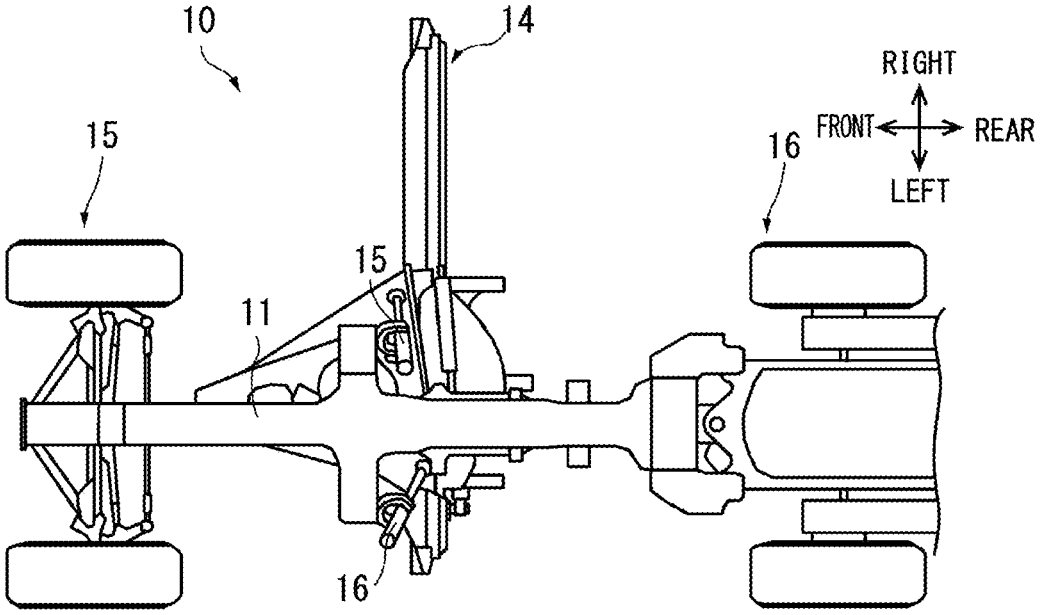
FIG. 14 is a plan view for describing an operation example of a motor grader according to one embodiment of the present invention.
Figure 15:
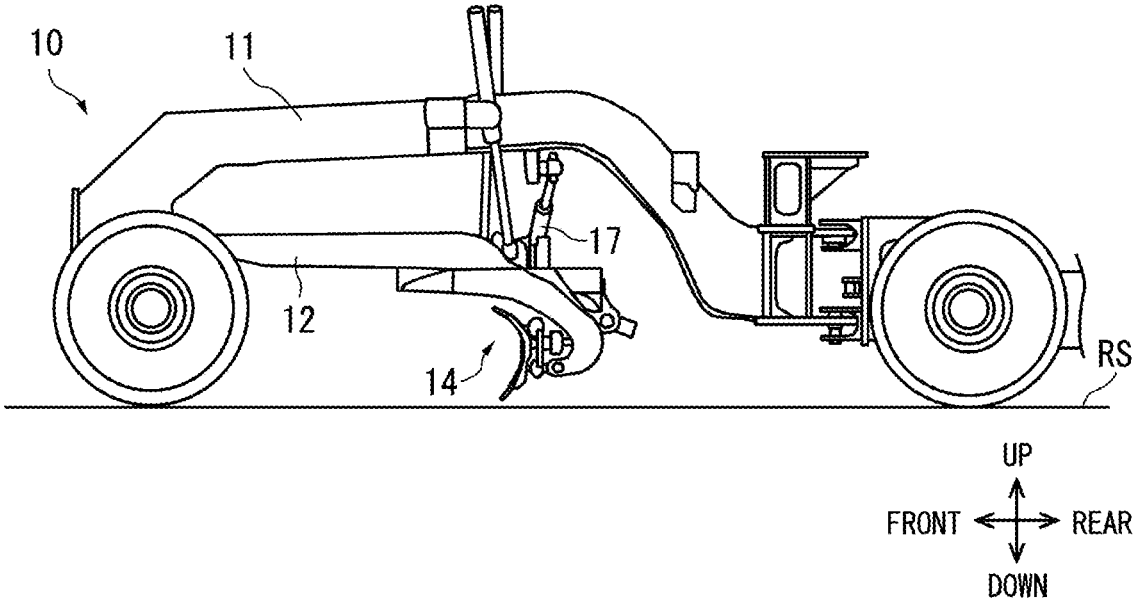
FIG. 15 is a side view for describing an operation example of a motor grader according to one embodiment of the present invention.

FIG. 14 is a plan view showing the motor grader 1 in a shoulder reach maximum (MAX) or minimum (MIN) posture. FIG. 15 is a side view showing the motor grader 1 in a shoulder reach maximum (MAX) or minimum (MIN) posture. In a case of transitioning to the shoulder reach maximum (MAX) or minimum (MIN) posture, it is necessary to lower the drawbar 12 without tilting the drawbar 12 around the front-rear axis, and at the same time, slide the drawbar 12, for example, to the right side at the maximum extent. In this case, the operator first performs a rotation operation around the axis in the left-right direction (rotation operation in the γj direction) and a rotation operation around the axis in the up-down direction (rotation operation in the αj direction) with respect to the joy stick 32 shown in FIG. 4, so that it is possible to lower the drawbar 12 without tilting the drawbar 12 around the front-rear axis (P direction in FIG. 2), and at the same time, slide the drawbar 12 to the right side at the maximum extent. Further, by shifting the slide switch 33, the blade 14 can be slid to the right.

In a case where achieving a shoulder reach maximum (MAX) using three operation levers that operate each cylinder length of the right blade lift cylinder 15, the left blade lift cylinder 16, and the drawbar shift cylinder 17, (1) first, the drawbar 12 is lifted to some extent by the right blade lift cylinder 15 and the left blade lift cylinder 16 (it is because the right side of the drawbar 12 is lowered by the operation (2)). (2) the drawbar shift cylinder 17 is used for maximum extension. (3) since the drawbar 12 tilts, the left side is lowered to adjust the drawbar 12 horizontal using the left blade lift cylinder 16. (4) the blade 14 is installed on the ground and the height thereof is adjusted using the right blade lift cylinder 15 and the left blade lift cylinder 16. (5) next, the blade 14 is slid to the right using the blade shift cylinder 24. The operation is complicated as compared with the present embodiment.

Figure 16:
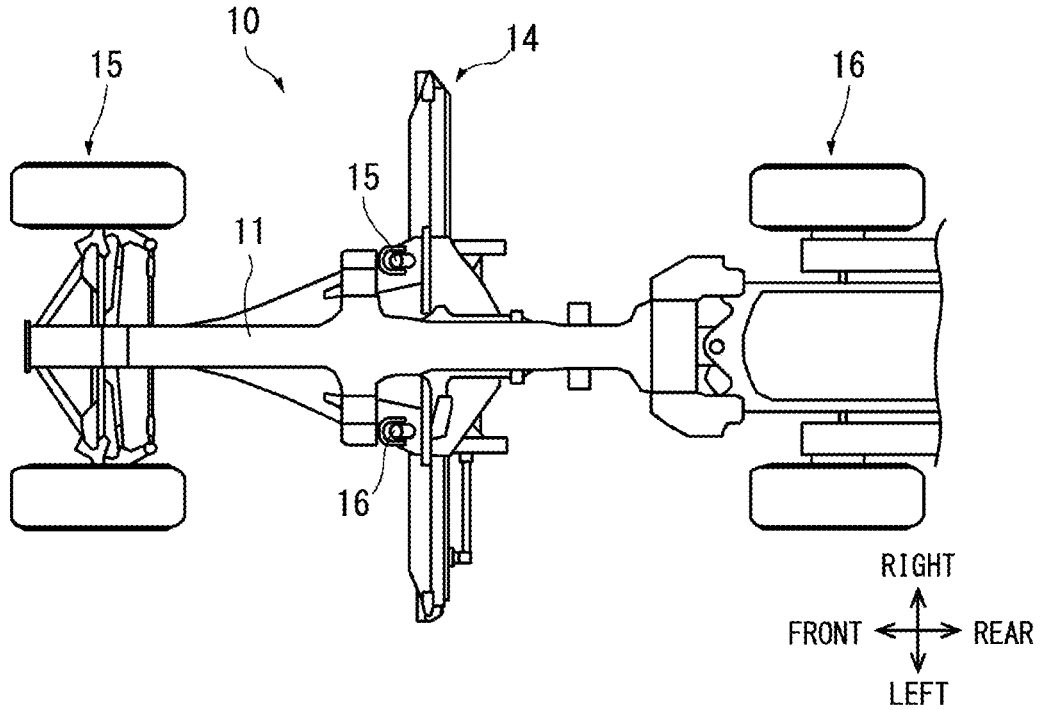
FIG. 16 is a plan view for describing an operation example of a motor grader according to one embodiment of the present invention.
Figure 17:
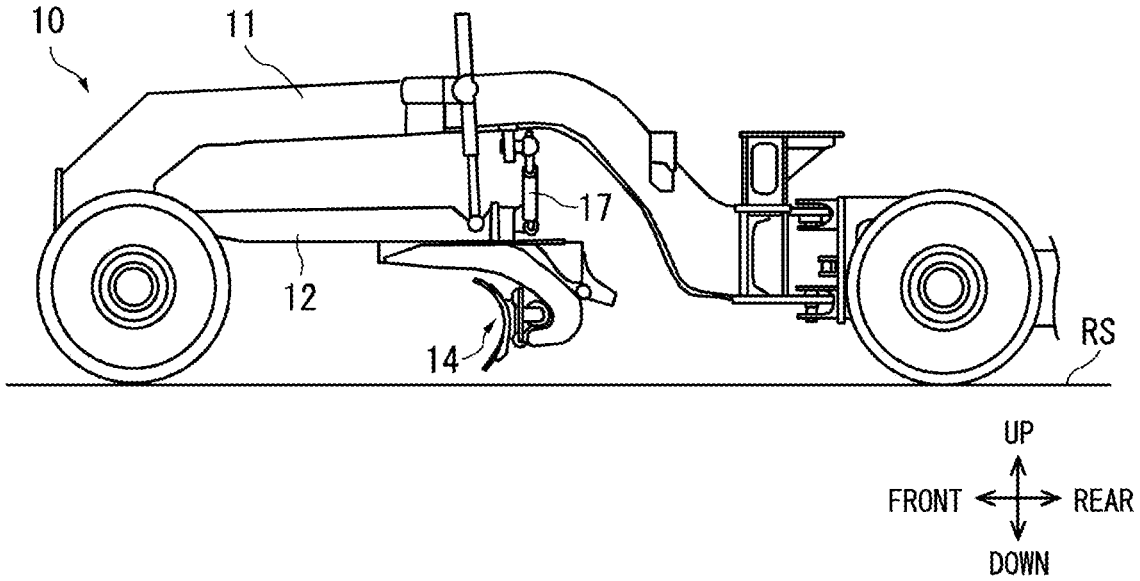
FIG. 17 is a side view for describing an operation example of a motor grader according to one embodiment of the present invention.

FIG. 16 is a plan view showing the motor grader 1 in a ground leveling work posture. FIG. 17 is a side view showing the motor grader 1 in a ground leveling work posture. In the ground leveling work posture, it is necessary to finely adjust the height of the drawbar 12 while traveling. In this case, the operator visually inspects the ground leveling and checks the ground leveling depth by the visual inspection, so that the drawbar 12 can be lowered without tilting the drawbar 12 around the front-rear axis β direction of FIG. 2) by the rotation operation (rotation operation in the γj direction) around the axis in the left-right direction with respect to the joy stick 32 shown in FIG. 4, and can immediately visually inspect the ground leveling again.

In a case where the ground leveling work posture is set by using the three operation levers that operate each cylinder length of the right blade lift cylinder 15, the left blade lift cylinder 16, and the drawbar shift cylinder 17, (1) first, the operator checks the ground leveling depth by the visual inspection, (2) lowers the drawbar 12 in parallel using the right blade lift cylinder 15 and the left blade lift cylinder 16, (3) lifts the left side using the left blade lift cylinder 16 to adjust the drawbar 12 to be parallel, for example, in a case where the left side is lowered too much, and (4) transitions to the visual inspection of the ground leveling. The operation is complicated as compared with the present embodiment.

Hitherto, the embodiment of the present invention has been described with reference to the drawings. However, a specific configuration is not limited to the above-described embodiment, and includes a design change within the scope not departing from the concept of the present invention. In addition, programs executed by a computer in the above-described embodiment can be partially or entirely distributed via a computer-readable recording medium or a communication line.

As described above, the controller 100 of the present embodiment is a control device that controls a drawbar attached to a main frame of a grader, in which a movement of the drawbar is generated by at least three actuators, and the control device controls, based on an output signal from one operation lever having at least three degrees of freedom, the plurality of actuators such that a movement of the one operation lever corresponds to the movement of the drawbar. The drawbar is restrained by the main frame and one ball shaft, and the axial rotation of the operation lever corresponds to the axial rotation of the drawbar about the ball shaft. Further, the operation lever includes an operation unit that operates a movement of a blade attached to the drawbar. In addition, in a case where the operation unit is slid left or right, the blade is slid left or right. In addition, the tilt of the operation lever corresponds to the tilt of the drawbar. In addition, the control system 300 of the present embodiment is an operation device including the control device and the operation lever. The motor grader 1 of the present embodiment is a work vehicle including a main frame, a drawbar attached to the main frame and restrained to the main frame by a ball shaft, three actuators attached to the main frame to determine a posture of the drawbar, one operation lever operated by an operator, and a control device that controls the actuators based on an output signal from the operation lever, in which the control device controls the actuators such that a movement of the operation lever corresponds to the movement of the drawbar.

According to each of these aspects, the operation can be simplified.

INDUSTRIAL APPLICABILITY

According to each aspect of the present invention, an operation can be simplified.

REFERENCE SIGNS LIST

1: Motor grader (work vehicle)
11: Main frame
12: Drawbar
14: Blade
15: Right blade lift cylinder (actuator)
16: Left blade lift cylinder (actuator)
17: Drawbar shift cylinder (actuator)
23: Ball shaft
100: Controller (control device)
300: Control system (operation device)
32: Joy stick (operation lever)
33: Slide switch

What is claimed is:

1. A control device that controls a drawbar attached to a main frame of a grader, wherein a movement of the drawbar is generated by at least three actuators, and the control device controls, based on an output signal from one operation lever having at least three degrees of freedom, the plurality of actuators such that a movement of the one operation lever corresponds to the movement of the drawbar, wherein the operation lever has a shape extending in an up-down direction, and includes a slide switch provided on a face of an upper tip side of the operation lever, wherein the face faces toward an operator side and the slide switch slides in a left-right direction within the face, wherein the drawbar is restrained by the main frame and one ball shaft, wherein an operation input of the operation lever in a rotation direction around an axis in the up-down direction is corresponded to a movement in a rotation direction of the drawbar about the ball shaft around an axis in the up-down direction, wherein a sliding operation input of the slide switch provided to the operation lever in the left-right direction is corresponded to a movement of a blade attached to the drawbar in the left-right direction.

2. The control device according to claim 1, wherein a tilt of the operation lever corresponds to a tilt of the drawbar.

3. An operation device comprising:

the control device according to claim 1; and the operation lever.

4. A control method for controlling a drawbar attached to a main frame of a grader, in which a movement of the drawbar is generated by at least three actuators, the control method comprising:

controlling, based on an output signal from one operation lever having at least three degrees of freedom, the plurality of actuators such that a movement of the one operation lever corresponds to the movement of the drawbar, wherein the operation lever has a shape extending in an up-down direction, and includes a slide switch provided on a face of an upper tip side of the operation lever, wherein the face faces toward an operator side and the slide switch slides in a left-right direction within the face, wherein the drawbar is restrained by the main frame and one ball shaft, wherein an operation input of the operation lever in a rotation direction around an axis in the up-down direction is corresponded to a movement in a rotation direction of the drawbar about the ball shaft around an axis in the up-down direction, wherein a sliding operation input of the slide switch provided to the operation lever in the left-right direction is corresponded to a movement of a blade attached to the drawbar in the left-right direction.

5. A work vehicle comprising:

a main frame;

a drawbar attached to the main frame and restrained to the main frame by one ball shaft;

three actuators attached to the main frame to determine a posture of the drawbar;

one operation lever operated by an operator; and a control device that controls the actuators based on an output signal from the operation lever, wherein the control device controls the actuators such that a movement of the operation lever corresponds to the movement of the drawbar, wherein the operation lever has a shape extending in an up-down direction, and includes a slide switch provided on a face of an upper tip side of the operation lever, wherein the face faces toward an operator side and the slide switch slides in a left-right direction within the face, wherein the drawbar is restrained by the main frame and the ball shaft, wherein an operation input of the operation lever in a rotation direction around an axis in the up-down direction is corresponded to a movement in a rotation direction of the drawbar about the ball shaft around an axis in the up-down direction, wherein a sliding operation input of the slide switch provided to the operation lever in the left-right direction is corresponded to a movement of a blade attached to the drawbar in the left-right direction.

* * * * *